United States Patent [19]

McGinnis et al.

[11] Patent Number: 5,025,606

[45] Date of Patent: Jun. 25, 1991

[54] GUY CONTROL SYSTEM FOR EXTENSIBLE MAST

[75] Inventors: Henry J. McGinnis, Fort Worth; Fred R. Hickman, Flower Mound; Wesley N. Ludwig, Arlington, all of Tex.

[73] Assignee: Rapid Deployment Towers, Inc., Azle, Tex.

[21] Appl. No.: 344,255

[22] Filed: Apr. 27, 1989

[51] Int. Cl.[5] ..... E04H 12/18

[52] U.S. Cl. ..... 52/741; 52/149; 52/152; 52/108

[58] Field of Search ..... 52/108, 741, 149, 152, 52/146

[56] References Cited

U.S. PATENT DOCUMENTS

| | | | |
|---|---|---|---|
| 3,147,829 | 9/1964 | Johnson et al. | 52/152 X |
| 3,150,740 | 9/1964 | Rubeli | 52/152 X |
| 4,625,475 | 12/1986 | McGinnis | 52/108 |

*Primary Examiner*—Carl D. Friedman

*Attorney, Agent, or Firm*—Kenneth C. Hill

[57] ABSTRACT

An extensible mast has a computer control for automatically deploying guy cables. As the mast is raised, the cables are deployed at a rate which retains the proper geometric relationships of the system. The system initially calculates the relative locations of the mast and cable anchor points, which can be placed in convenient locations. A winch suitable for use with the system measures the tension on deployed guy cables and the length of cable which has been unwound from the winch drum.

22 Claims, 7 Drawing Sheets

GUY CONTROL SYSTEM FOR EXTENSIBLE MAST

CROSS-REFERENCE TO RELATED APPLICATIONS

The present application contains subject matter related to copending U.S. patent application Ser. No. 178,563, filed Apr. 7, 1988, titled EXTENSIBLE MAST, now issued as U.S. Pat. No. 4,866,893, and U.S. patent application Ser. No. 126,500, filed Nov. 30, 1987, titled EXTENSIBLE MAST SUPPORT SYSTEM, now allowed U.S. Pat. No. 4,850,161, both of which are assigned to the Assignee hereof, and both of which are herein incorporated by reference.

BACKGROUND OF THE INVENTION

1. Field of the Invention

The present invention relates generally to extensible and retractable masts, and more specifically to an electronic or computer control system for controlling erection of such a mast.

2. Description of the Prior Art

Extensible masts and towers of various types are known in the prior art. An example of one such type of extensible mast is shown in U.S. Pat. No. 4,625,475, EXTENSIBLE MAST, by McGinnis, which is herein incorporated by reference. Such patent shows the creation of an extensible mast by placing three flexible metal tapes edge-to-edge to form a triangular cross-sectioned member. Cables are wrapped around the mast in order to make it rigid. The extensible mast described in the McGinnis patent is extended from a central location by wrapping cable around the triangular member formed by unrolling three spools of flexible metal material so that they form a triangular cross-section.

Towers and masts generally use a plurality of cables attached from selected points of the mast to anchor points on the ground in order to provide horizontal support for the mast. These are generally referred to as guys or guy cables. Three or four anchor locations are typically provided at points spaced away from the base of the mast. These anchor points are preferably located in directions from the mast which are equally spaced around a circle. Each anchor position may be located at different distances from the base of the mast.

Location of anchor points for a fixed mast or tower must take several conditions into consideration. Improved horizontal support of the mast or tower is provided by spacing the anchor positions as far away from the mast as possible. However, various terrain restrictions and other requirements may require that some anchor positions be located closer to the mast than others. Also, the terrain may dictate that some anchor locations be located at significantly different elevations from the base of the mast and from each other.

For taller structures, it is usually desirable or necessary to have guy cables located at several points along the height of the structure. For example, guy cables could be attached to the tower at every 50 feet of height, so that a 200 foot tower would have four sets of guy cables. One cable from each height is typically run to a single anchor location, so that the 200 foot tower would have four guy cables attached to each anchor point. These additional cables attached along the height of the tower prevent both bending of the tower due to horizontal loads and divergence from the vertical axis, and are especially desirable for masts which have a minimum amount of horizontal structural support. The extensible mast described above falls in this catagory, and preferably has several sets of guy cables along its height for tall structures.

In extensible masts of the type described above, the guy cables must be attached as the mast is being erected, and must be deployed from the anchor points at a rate consistent with the rate at which the mast is being raised. If the various anchor points are located at different distances from the mast, and at different heights relative to the base of the mast, deploying the guy cables as the mast is raised can be a very difficult process.

It would therefore be desirable for an automatic controller to adjust the rate at which guy cables are paid out from, and taken up at, anchor points in order to support an extensible mast while it is being extended or retracted. It would be further desirable if such controller could automatically compensate for variations in anchor point placement.

SUMMARY OF THE INVENTION

It is therefore an object of the present invention to provide a control system for guy cables for an extensible mast.

It is a further object of the present invention to provide such a control system which automatically compensates for variations in anchor point placement.

Therefore, in accordance with the present invention, an extensible mast has multiple anchor points for guy cables. An electronic control system controls the rate at which the mast is erected and the guy cables are deployed. A preferred electric winch for use with the guy cables provides an accurate indication of the length of the cable which has been paid out from or taken up by the winch.

BRIEF DESCRIPTION OF THE DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

DESCRIPTION OF THE PREFERRED EMBODIMENT

Figures 1, 1A:
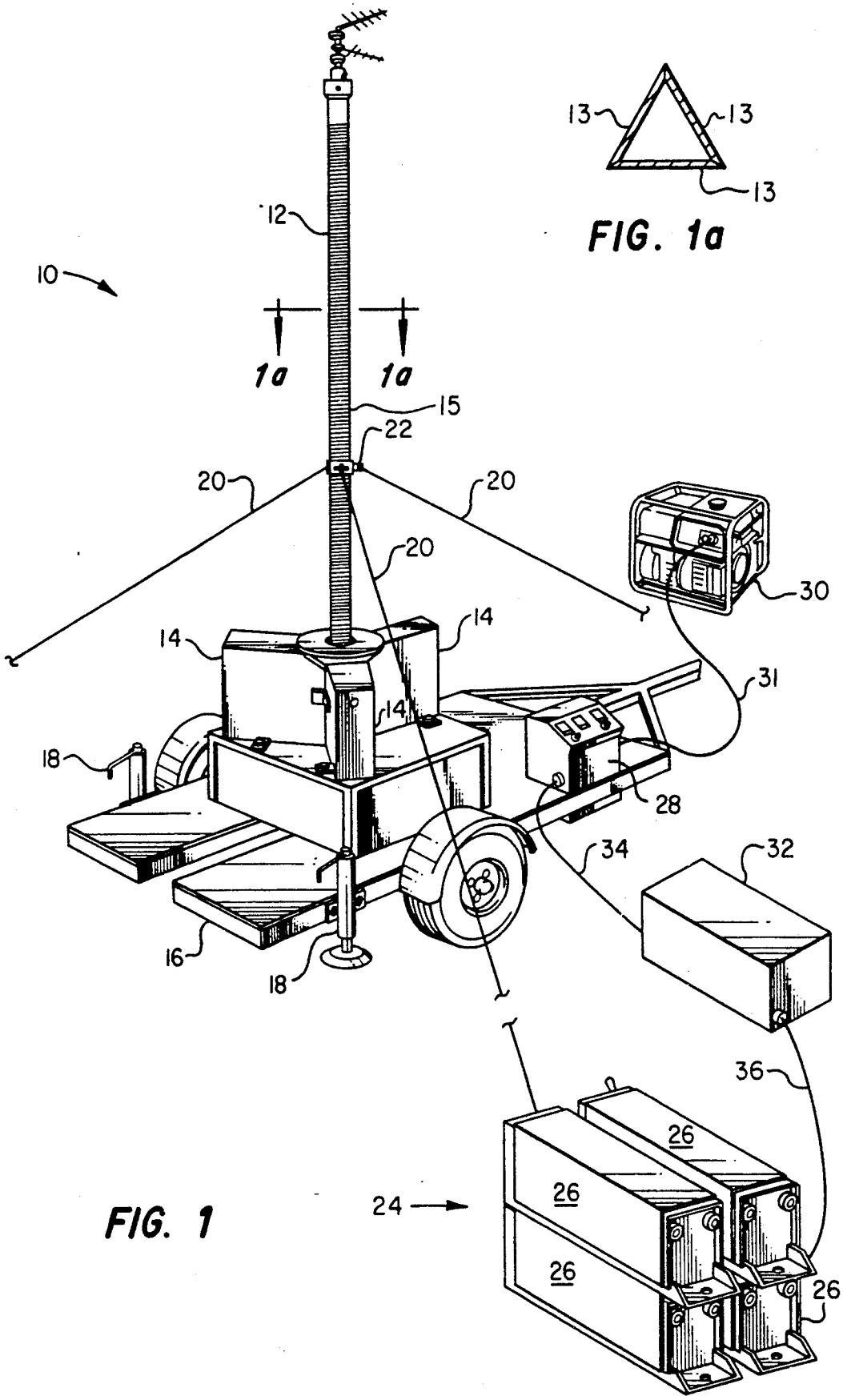
FIG. 1 is a partial perspective view of an extensible mast according to the present invention.

Referring to FIG. 1 and 1*a* an extensible mast assembly 10 contains all of the equipment needed to erect an extensible mast 12. The mast 12 comprises three flexible metal tapes 13 connected at the edges to form a triangular cross-section, and being wrapped by wire 15 to bind the tapes into a rigid structure. Such an extensible mast 12, and the mechanism for raising the mast 12 and winding it with wire are described in more detail in the prior art references cited in the Background and as related applications.

Three housings 14 contain the flexible metal tapes on rolls, and are mounted on a trailer 16. The three housings 14 project radially from the centerline of the mast 12, and are spaced 120° apart. One of the housings 14 is preferably aligned with a long axis of the trailer 16. Screw jacks 18 are used to securely support the trailer 16 once it has been towed into position. Any other means for firmly supporting the trailer 16, such as are known in the art, can be used instead of the screw jacks 18 shown in FIG. 1.

Three guy cables 20 are attached to the mast 12 by a guy cable coupling 22. This coupling 22 is preferably triangular in shape, and fits snugly on the mast 12. The guy cables 20 are aligned with the housings 14, and connect on an end opposite the coupling 22 to anchor point assemblies 24. For purposes of description, only a single anchor point assembly 24 is shown in FIG. 1, but it is understood that similar structures will be found at the end of each of the other guy cables 20. Each anchor point assembly 24 contains four winches 26.

A computer control unit 28 is mounted on the trailer 16, and powered by a generator 30. The generator 30 is connected to the control unit 28 by a power cable 31, which is preferably long enough to allow the generator to be placed some distance away from the trailer 16. A cable 31 length of 50 or 100 feet allows mast extension operations to be performed at the trailer 16 under relatively quiet conditions.

Each anchor point assembly 24 has an associated control unit 32. These control units 32 will also be referred to as vector controllers. Connecting cable 34 transmits control and data signals between the computer controller 28 and the vector controller 32, and connecting cable 36 transmits control and data signals between the vector controller 32 and the individual winches 26. Connecting cables 34 and 36 contain several signal lines for transmitting the various control signals described below.

In FIG. 1, the extensible mast is shown only partially extended. The mast 12 can be extended to a height of several hundred feet, which necessitates guy cables at various vertical intervals along the mast 12 as known in the art. In the extensible mast assembly 10, each winch 26 is used for one guy cable 20, with the four winches 26 in each anchor point assembly 24 allowing four different guy cables to be attached to the extensible mast 12 at four different vertical locations. If desired, the system can be modified slightly to accommodate a greater or lesser number of winches 26 at each anchor point assembly 24, allowing for control of extensible masts 12 of various heights.

Figure 2:
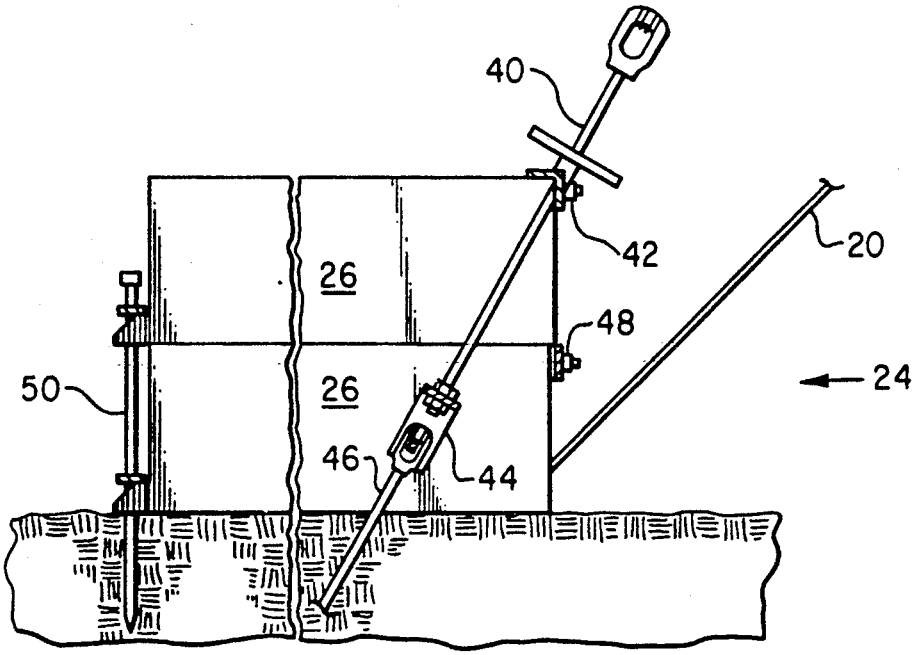
FIG. 2 illustrates a preferred technique for anchoring winches.

FIG. 2 illustrates a preferred technique for anchoring the winches 26 to the ground. An upper anchor bracket 40 is bolted to an angle rod 42, which is in turn attached to the upper edges of the two top winches 26 which face the mast 12. The lower end of the upper anchor rod 40 is connected to a coupling 44, which in turn is connected to a screw rod 46. The lower end of the screw rod 46 is an auger (not shown), which is screwed into the ground beneath the anchor point assembly 24. The winches 26 are preferably stacked as two columns of two, and the upper anchor rod 40, coupling 44, and screw rod 46 preferably pass between the two columns of winches 26.

The winches 26 in the upper row preferably have a flange 48 projecting from the lower edge thereof, which is bolted to the lower winch 26. A rear anchor pin 50 passes through appropriate openings in the rear of each winch 26, and into the ground beneath. The combination of the rear anchor pin 50, upper anchor rod 40 attachment to the angle iron 42, and bolted flange 48, work to hold the anchor point assembly 24 as a single unit, and anchor it firmly into the ground.

Figure 3A:
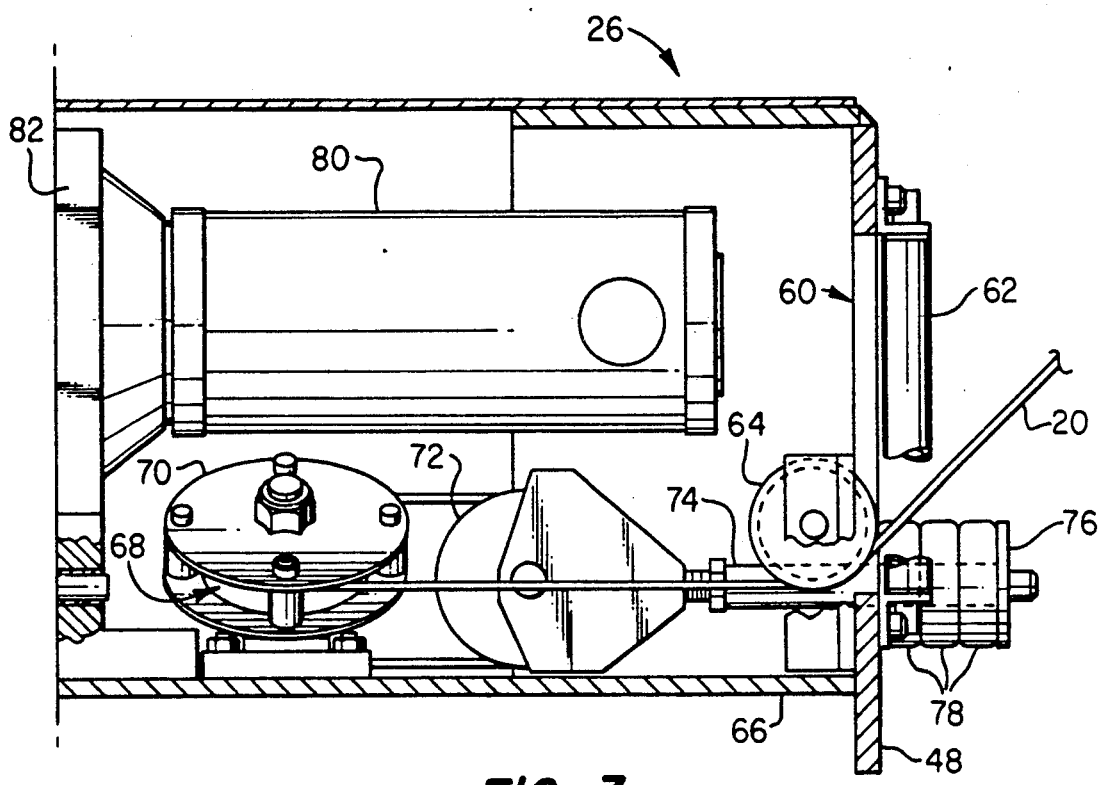
FIGS. 3*a*–3*b* are a cut-away view of a preferred winch for guy cables.
Figure 3B:
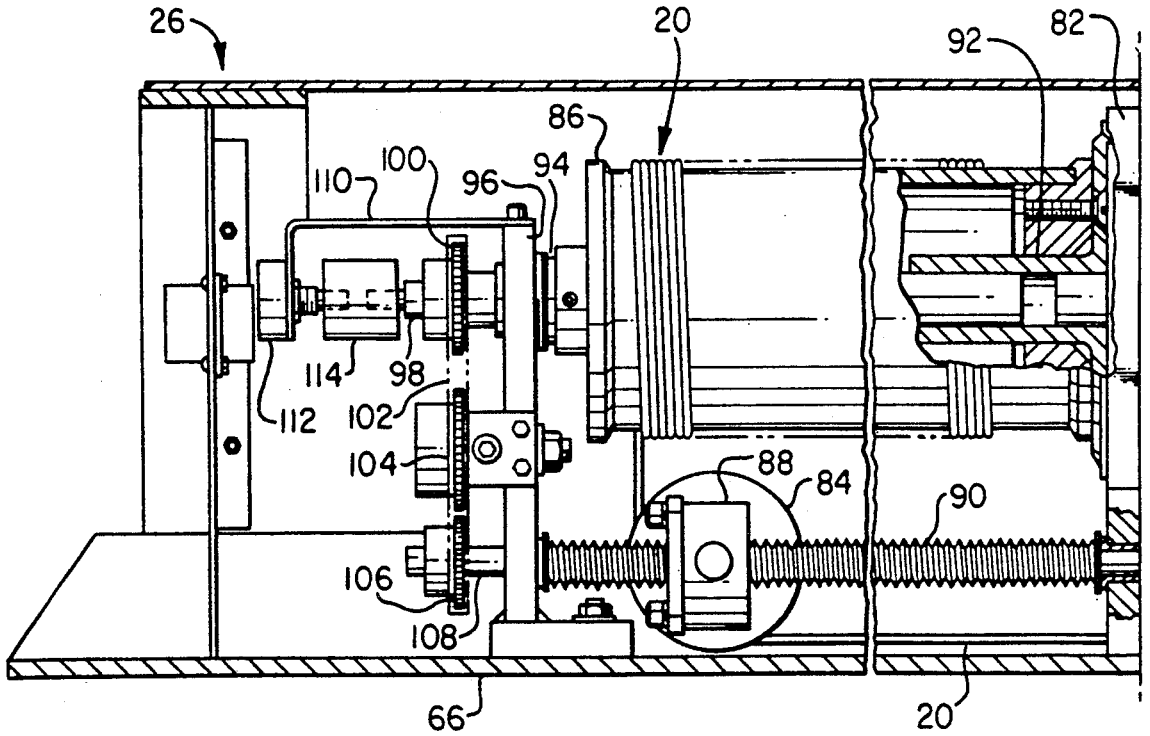

FIGS. 3*a* and 3*b* show a cut-away elevation of a preferred design for the winches 26. FIG. 3*a* is drawn so as to be placed with its left edge adjacent to the right edge of FIG. 3*b*, whereby the interior of the entire winch 26 can be seen.

Referring to FIG. 3*a*, each winch 26 has a front slot 60 through which the guy cable 20 passes. This slot is several times as wide as the diameter of the guy cable 20 and relatively tall. To either side of the slot 60 is a smooth roller 62. If the winch 26 is not aligned perfectly with the mast 12, the rollers 62 will maintain proper alignment of the guy cable 20 with the first sheave 64.

A first sheave 64 is attached to the winch housing 66 just inside of the slot 60. The guy cable 20 passes the lower portion of the first sheave 64, and continues toward the rear of the winch 26.

The guy cable 20 passes around second sheave 68, which is supported in second sheave housing 70. It then returns toward the front of the winch 26, and passes around third sheave 72. From the lower edge of third sheave 72, the guy cable 20 extends into the rear portion of the winch 26.

The axle of the third sheave 72 is attached to a tension transducer 74, which has an axis which is parallel to the spans of guy cable 20 which extend between the first, second, and third sheaves. The tension transducer 74 has a rear flange 76 which is located outside of the winch housing 66. Three rubber washers 78 are located between the transducer flange 76 and the outside face of the winch housing 66.

The arrangement of sheaves shown in FIG. 3 translates tension along the guy cable 20 into a tension readable by the tension transducer 74. The sheaves 64 and 68 are fixed. The third sheave 72 is also fixed, having only a small amount of give due to the compressibility of the washers 78. Considered statically, the third sheave 72 is fixed; considered dynamically, with varying tensions along the guy cable 20, the third sheave 72 is mounted slightly flexibly. Materials other than the rubber washers 78 may be used to supply the slight amount of flexibility desired in the preferred embodiment.

An electric motor 80 is mounted on a planetary gear unit 82. The DC motor 80 is designed to operate with a four quadrant regenerative controller. The motor 80 is controlled by an analog signal to increase or decrease its torque in either direction.

The remainder of the winch 26 is shown in FIG. 3*b*. The guy cable 20 passes over a fourth sheave 84 and is wound on a drum 86. The fourth sheave is rotatably mounted on a block 88, which in turn is attached to a lead screw 90. The lead screw 90 passes through the block 88, while the fourth sheave 84 is mounted on one side of the block 88. One end of drum 86 is mounted to the gear unit 82 with a coupling 92, and the other end of the drum 86 is supported by a bearing 94 mounted in a support frame 96.

The guy cable 20 is laid down on the drum 86 in a single layer. The mount block 88 is threaded internally, so that rotation of the lead screw 90 causes the block 88 to move along the lead screw 90. The pitch of the threads of lead screw 90 is chosen so that the mounting block 88 moves along the lead screw 90 in such a manner that the guy cable 20 always comes off the drum 86 at right angles as shown in the drawing. If the drum 86 and lead screw 90 are coupled so as to rotate at the same rate, the thread spacing on the lead screw 90 should be equal to the diameter of guy cable 20.

The drum axle 98 extends through the bearing 94, and a driving sprocket 100 is attached thereto. A drive chain 102 is driven by the sprocket 100, and passes over an idler sprocket 104 which is mounted on the support frame 96. A sprocket 106 is mounted on an axial extension 108 of the lead screw 90. As the drum 86 is driven in either direction by the motor 80, the drive chain 102 causes the lead screw 90 to be driven in the same direction. This causes lead screw 90 and drum 86 to rotate in lock step, ensuring that the fourth sheave 84 always addresses the correct portion of the drum 86 as described above. If the thread pitch on the lead screw 90 is the same as the diameter of the guy cable 20, gears 100 and 106 should have the same number of teeth. If the lead screw 90 has a different thread pitch, the relative number of teeth on the gears 100 and 106 should be selected as known in the art in order to make the lead screw 90 rotate at the correct relative speed.

A support arm 110 supports a shaft encoder 112. Encoder 112 is supported coaxially with the drum axle 98, and is connected thereto with a coupling 114. The encoder 112 is driven to rotate in step with the drum 86. As will be described in connection with FIG. 4, electrical signals from the encoder 112 can be used to determine the length of guy cable 20 passed to and from the drum 86.

The winch shown in FIG. 3 has some features which are especially advantageous when used with an extensible mast as described above. The overall winch assembly 26 is relatively long along the axis of the drum 86. This helps keep the anchor point assembly 24 firmly anchored to the ground. Since only a single layer of guy cable 20 is wound on the drum 86, each rotation of the drum 86 passes exactly the same length of guy cable 20. As will be described below, it is important to know how much guy cable 20 has been deployed from the winch 26, and this design simplifies this determination.

The slightly compressible washers 78 used in the mounting of the transducer 74 damp tension variations which occur on the guy cable 20. If the transducer 74 is rigidly coupled to the winch housing 66, undesired feedback of tension fluctuations can be transmitted between various winches through the mechanical portions of the system. This can cause oscillations in the values read by the transducer 74, giving rise to instabilities in the system. The damping effect of the slightly compressible washers 78 tends to reduce these oscillations, and results in a more stable, controllable system.

Figure 4:
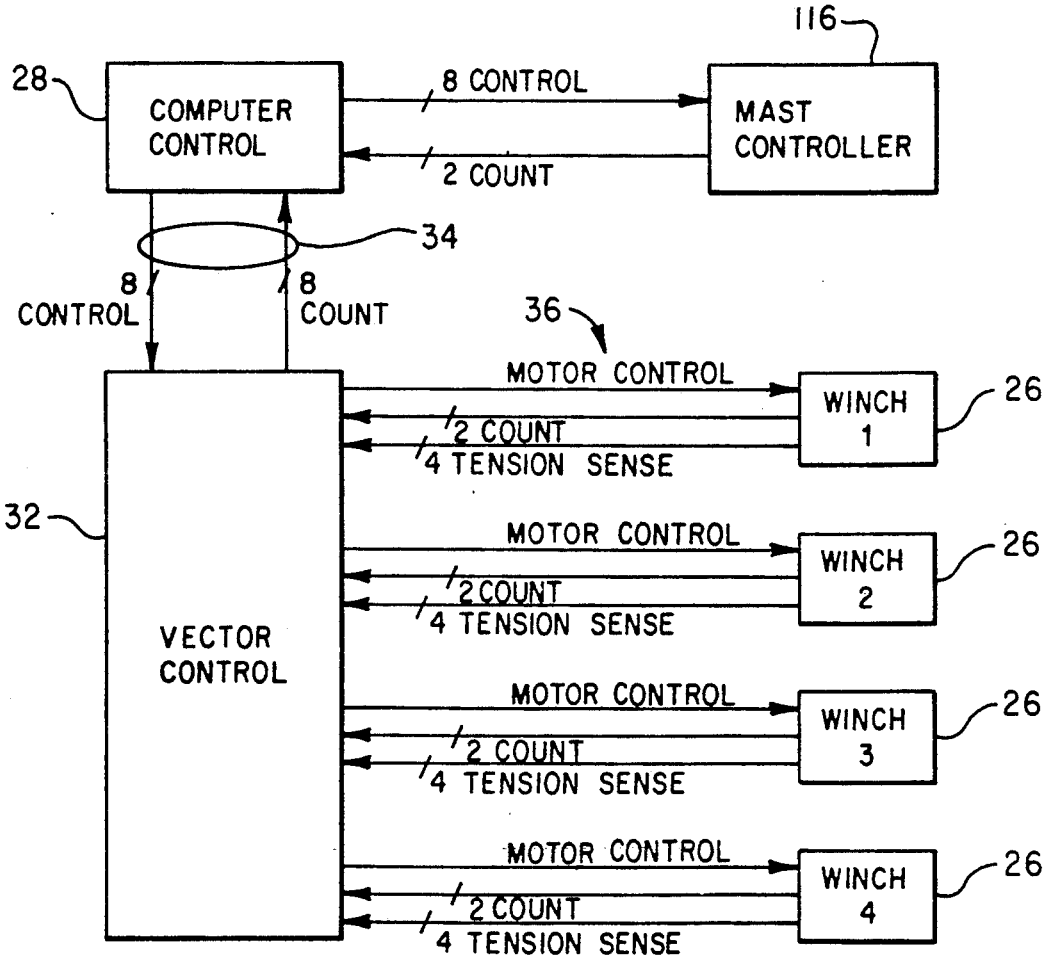
FIG. 4 is a block diagram of a preferred controller.

FIG. 4 is a block diagram of an electronic control system for use with the assembly 10. The computer control 28 is connected to the vector control 32 by connecting cable 34. Within connecting cable 34 are 8 control signals which are sent to all of the vector controls 32 by the computer control 28. Also contained within cable 34 are 8 encoder signals which count the rotation of the winch drums and which are returned to the computer control 28 by the vector control 32. The control signals will be described in more detail in connection with FIG. 5.

Each vector controller 32 controls four winches 26. Similar control signals are transferred between the vector controller 32 and each winch 26. A tension control signal is an analog signal used to control the electric motor 80. Each winch returns tension sense signals which are generated by the transducer 74. Also returned is a countup or countdown signal.

Each vector controller has a decoder circuit that decodes the 8 control signals coming from the computer control 28. This circuit decodes the commands as to winch address and function so that each function of each winch has its own unique code. This allows 256 unique commands to be carried over 8 wires.

The countup/countdown signals returned by each winch 26 are generated by the encoder 112. In order to sense the direction of drum 86 movement, two separate signal lines are provided. Pulses are generated on these lines in quadrature (i.e., 90° apart). If the first pulse occurs on one signal line the drum is moving in a first direction; if the first pulse is transmitted on the second signal line, the drum 86 is moving in the other direction. In a preferred embodiment, 128 pulses are generated on each line for each revolution of the drum 86. This gives a measurement granularity of 1/128th of a drum 86 circumference for the length of the guy cable 20. For example, if the circumference of the drum 86 is 12.8 inches, the length of guy cable 20 passed from the drum 86 is known to the nearest 0.1 inch.

The count signals received from the four winches are not processed by the vector controller 32. Instead, they are simply transmitted back to the computer controller 28 through the connecting cable 34.

A mast controller 116 functions in a manner somewhat similar to that of the three vector controllers 32. Count signals are provided to the computer controller 28 to indicate the length of the mast which has been extended. The computer controller provides control signals to the mast controller 116 to indicate whether the mast is to be raised or lowered, and at what rate.

Figure 5A:
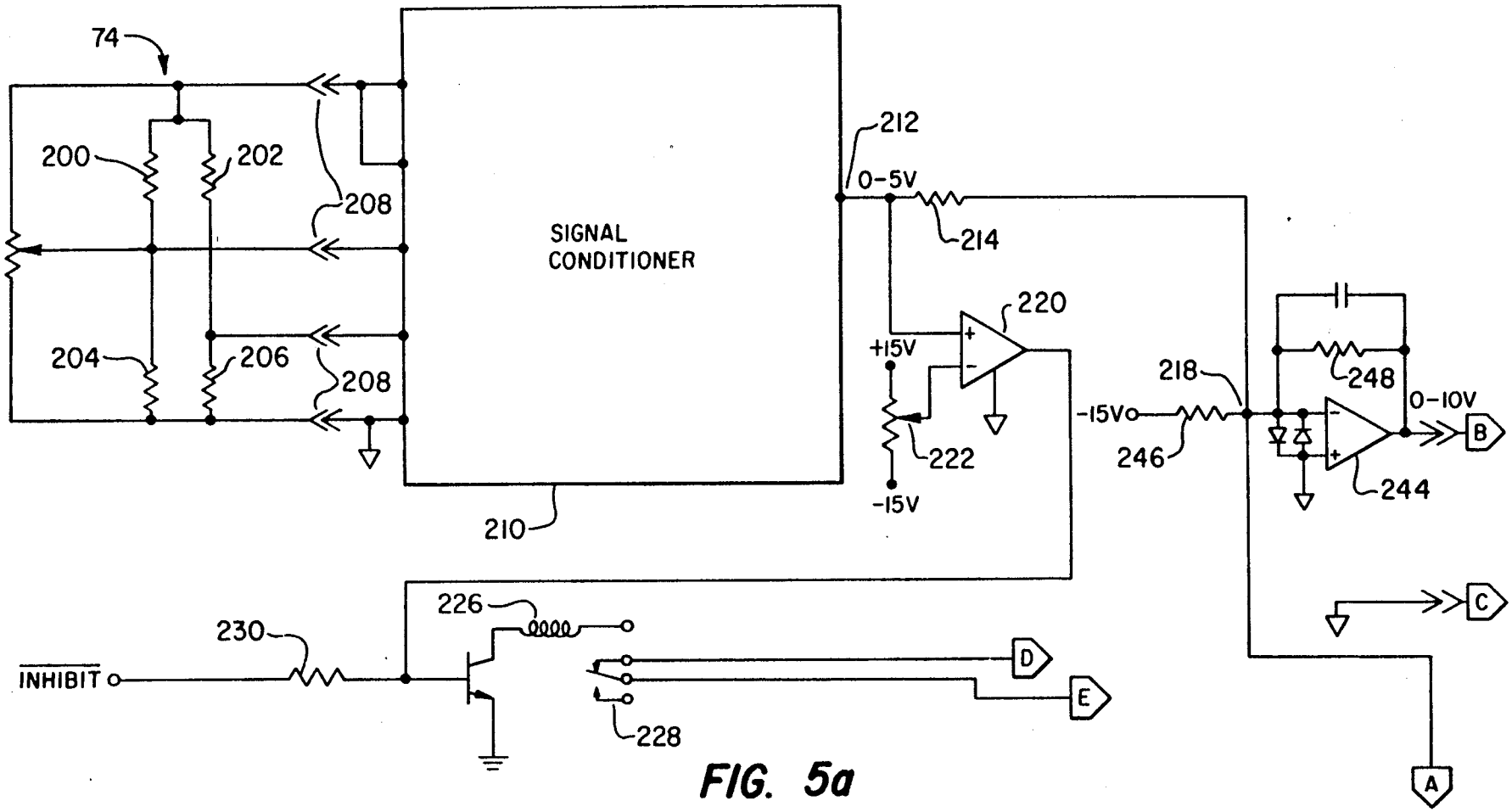
FIGS. 5*a*–5*c* are a schematic diagram of portions of a controller for guy cables.
Figure 5B:
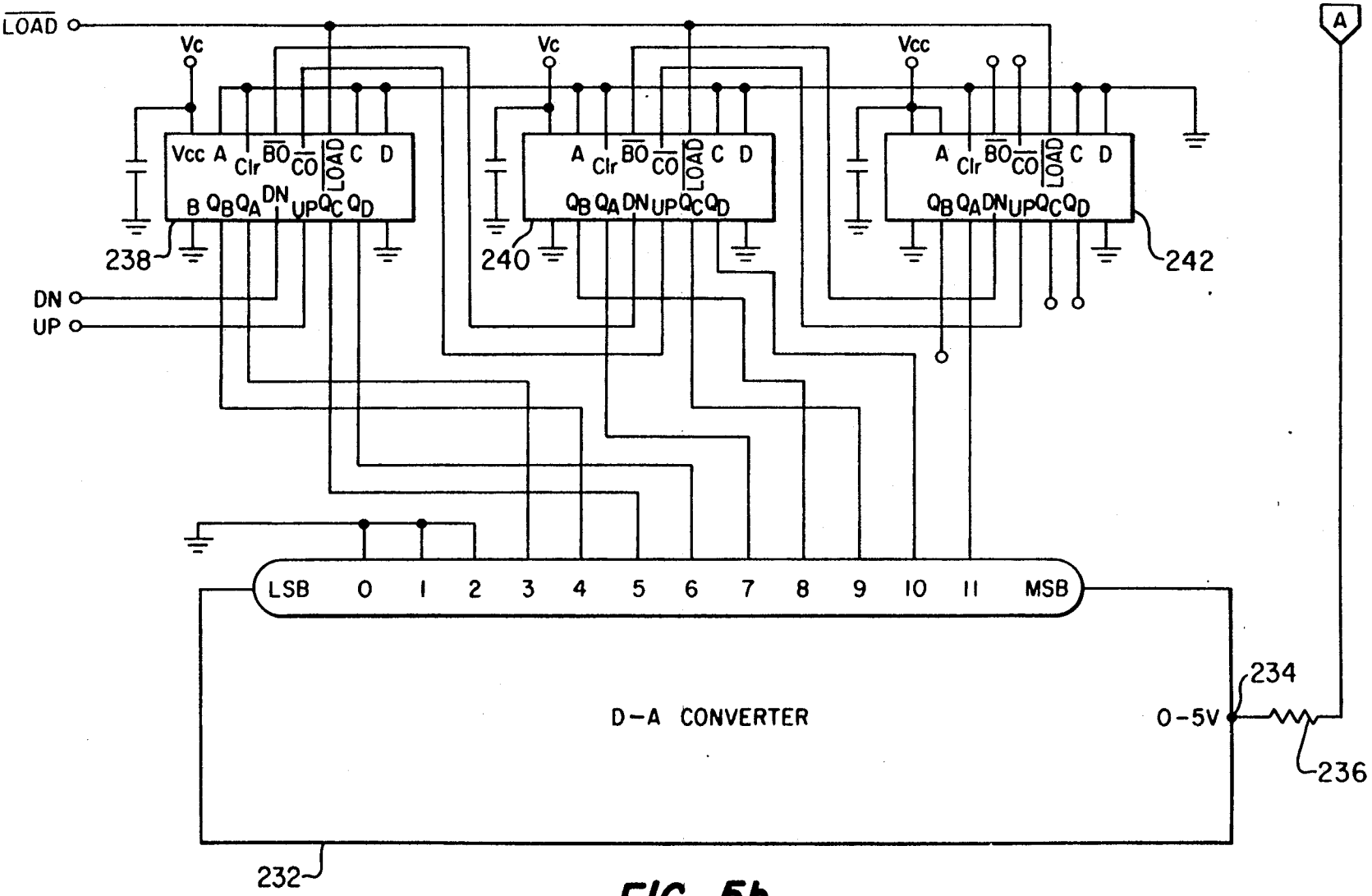
Figure 5C:
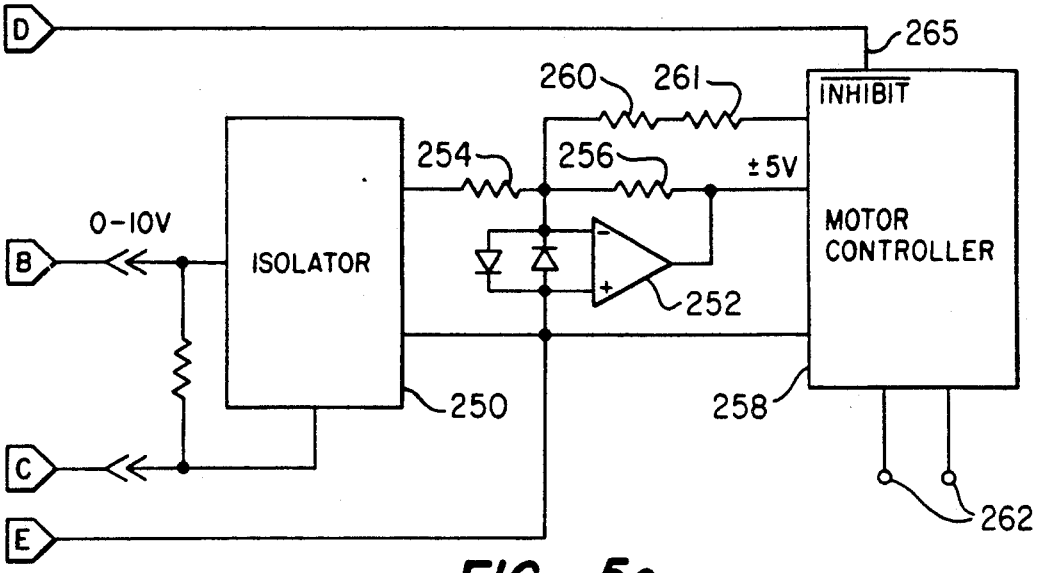

FIG. 5 illustrates a preferred implementation of the vector controller 32. The schematic diagram set forth in FIGS. 5*a*, 5*b*, and 5*c* illustrates the circuitry necessary for controlling one winch 26 within the vector controller 32. If four winches 26 are used at each anchor point 24, four sets of the circuitry shown in FIG. 5 will be included within the vector controller 32.

Referring to FIG. 5*a*, the transducer 74 is represented by resistors 200, 202, 204, 206. The transducer 74 is connected through connectors 208 to a signal conditioner 210 which excites the transducer 74 and senses the variations representing tension. The signal conditioner 210 can be a commercially available integrated circuit, such as a 1B31 from Analog Devices. FIG. 5*a* does not indicate the power supply and offset balancing inputs to the signal conditioner 210, which are known by those skilled in the art for such devices.

The output from the signal conditioner 210 is available at output pin 212, and varies within the range 0 to 5 volts according to the preferred embodiment. Resistor 214 couples the output from pin 212 to the summing node 218.

Output pin 212 is also connected to the positive input of comparator 220. The negative input of the comparator 220 is connected to a potentiometer 222 which is adjustable between the positive and negative supply voltages. The comparator 220 is connected in an open loop configuration as shown, so that its output will be driven to the positive supply voltage or ground depending on whether its positive input is greater or less than its negative input. This comparator 220 is used as a slack sensor for the guy cable 20. When the output at pin 212 becomes very low, this indicates that a slack, or no-load, condition exists for the associated guy cable 20. The potentiometer 222 is adjusted so that the voltage into the negative terminal of the comparator 220 is equal to the voltage output from the signal conditioner 210 when the desired minimal tension exists. Whenever the tension of the guy cable 20 drops below this value, the output from the comparator 220 goes to ground.

The output from the comparator 220 is connected to an NPN transistor 224. The transistor 224 drives relay coil 226, which in turn drives relay contacts 228. Relay 228 is normally closed, so that transistor 224 must be turned on in order to open the relay connection. As described in connection with FIG. 5*c*, motor 80 operation is inhibited whenever relay 228 is closed.

Transistor 224 is normally turned on by the signal $\overline{\text{INHIBIT}}$ which is connected to the base thereof through resistor 230. The signal $\overline{\text{INHIBIT}}$ is generated by the computer control 28, and is used to inhibit motor 80 operation. When it is desired that all of the motors 80 be inhibited, the computer control 28 drives $\overline{\text{INHIBIT}}$ low for every winch 26. Even when $\overline{\text{INHIBIT}}$ is high, if a slack condition exists for any particular guy cable 20, the output of comparator 220 will be low. This causes the voltage at the base of transistor 224 to be driven to ground, stopping motor 80 operation for that guy cable regardless of the status of $\overline{\text{INHIBIT}}$. Resistor 230 serves to limit the current which the comparator 220 must sink.

Referring to FIG. 5*b*, a digital to analog converter 232 (DAC) generates an output signal at pin 234 which is connected to node 218 of FIG. 5*a* through resistor 236. The DAC 232 can be a commercially available part, such as the AD767 from Analog Devices. The output voltage at node 234 preferably varies between −5 and +5 volts depending upon the input.

Only 9 bits in the DAC 232 are needed in the described implementation, so the 3 least significant bits (LSB) of the input to the DAC 232 are connected to ground. Three four-bit binary counters 238, 240, 242 have outputs connected to the 9 most significant bits (MSB) of the DAC 232. These counters 238, 240, 242 can be, for example, SN74LS193 parts available from several sources. As illustrated in FIG. 5*b*, these three counters 238, 240, 242 are connected together to form a 9 bit up-down counter as known in the art.

The signal $\overline{\text{LOAD}}$ is generated by the computer control 28, and is used to reset the counters 238, 240, 242 during initialization or when otherwise desired. Two inputs from the computer control 28 are connected to the DN and UP inputs of counter 238. The DN and UP signals are used to decrease or increase the value stored in the counters, and thus control the DAC 232.

The number stored at any given time in the counters 238, 240, 242 represents the desired tension on one guy cable 20. If more tension is desired on a guy cable 20, the computer control 28 sends an appropriate number of pulses to the UP input. This increases the output of the counters, thereby increasing the analog voltage at output pin 234. In a similar fashion, if it is necessary to decrease the tension on a guy cable 20, pulses are communicated on the DN input.

The counters 238, 240, 242 are not clocked, so that pulses into the DN and UP inputs are immediately reflected at the output pin 234. Since the numbers stored in the counters is representative of a desired tension on a guy cable 20, the output voltage at pin 234 is an analog value indicating the desired tension on one guy cable 20. Along with the $\overline{\text{INHIBIT}}$ input signal of FIG. 5*a*, the $\overline{\text{LOAD}}$, DN, and UP signals represent the four control signals generated by the computer control 28 for each winch 26 as shown in FIG. 4.

Returning to FIG. 5*a*, operational amplifier 244 has it minus input connected to node 218. The −15 volt supply is also connected to node 218 through resistor 246. With feedback resistor 248 also connected to the minus input, operational amplifier 244 operates as an inverting, summing amplifier. The −15 volts supply and resistor 246 establish a fixed DC offset at the output at which is modulated by the voltages from nodes 212 and 234 and summed node 218. This is the mechanism by which the current tension level is compared with the desired values set by the computer control 28. The values of resistors 214, 236, 246, 248 are preferably selected so that the output of operational amplifier 244 is a single ended value varying between 0 and 10 volts. In one implementation, the values of resistors 214 and 236 can be 10K ohms, resistor 246 can have a value of 60K ohms, and resistor 248 can have a value of 20K ohms.

The output of operational amplifier 244 is an error signal which indicates whether the guy cable 20 tension level is too high or too low. A value of exactly 5 volts out of operational amplifier 244 indicates that the tension vs. demand is nulled. This analog output is the signal TENSION CONTROL described in connection with FIG. 4, and is communicated to an isolator 250.

Referring to FIG. 5*c*, that portion of the control circuitry is contained in the vector control 32 (FIG. 1). The output from operational amplifier 244 is connected to an input to an opto-isolator 250. This device can be, for example, a PCM3 isolator available from Minarik. Operational amplifier 252, using resistors 254 and 256 to set the gain and resistors 260 and 261 to establish an offset, converts the output from isolator 250 to a −5 to +5 volt signal full scale for input to a motor controller 258. The controller 258 can be, for example, an RG100UC controller available from Minarik. This is preferably a four quadrant regenerative controller, which drives the motor 80 through bi-directional outputs 262. The controller 258 provides an inhibit circuit input 265 controlled by relay contacts 228 as described in connection with FIG. 5*a*. This signal is used to stop the motors 80.

As described above, the computer control 28 sets the desired tension on each guy cable 20, and reads the length of each cable 20 in return. The error signal generated at the output of operational amplifier 244 causes the guy cable 20 to lengthen if the tension thereon becomes higher than the selected value, and to shorten if the tension become too low. The computer control 28 knows only the length of all of the guy cables 20, and the height of the mast 12. Using this information, it must adjust the guy cables 20 to maintain their length appropriate to the current height of the mast 12. If a cable 20 is longer than the required value calculated by the computer control 28, the tension level is increased for that cable 20. If a cable 20 is shorter than the calculated value, the tension set point for that cable 20 is decreased.

The differences in tension between the various cables 20 determines whether the mast 12 is vertically oriented. Adjustments made during the raising or lowering of the mast 12 may cause the tension on all of the cables 20 to become too high or too low. If the magnitudes of the tension on the various cables 20 moves above or below a preselected window, the control 28 causes the tension of all cables 20 to be increased or decreased proportionally so they will all fall within the window. This maintains the vertical orientation of the mast while keeping the cables from becoming too taught or too slack.

Thus, to the computer control 28, the primary factor of importance is the current geometry of the system 10. When the lengths of the guy cables 20 are appropriate for the height of the mast 12, the mast 12 will be vertical and the system will be properly configured.

Figure 6:
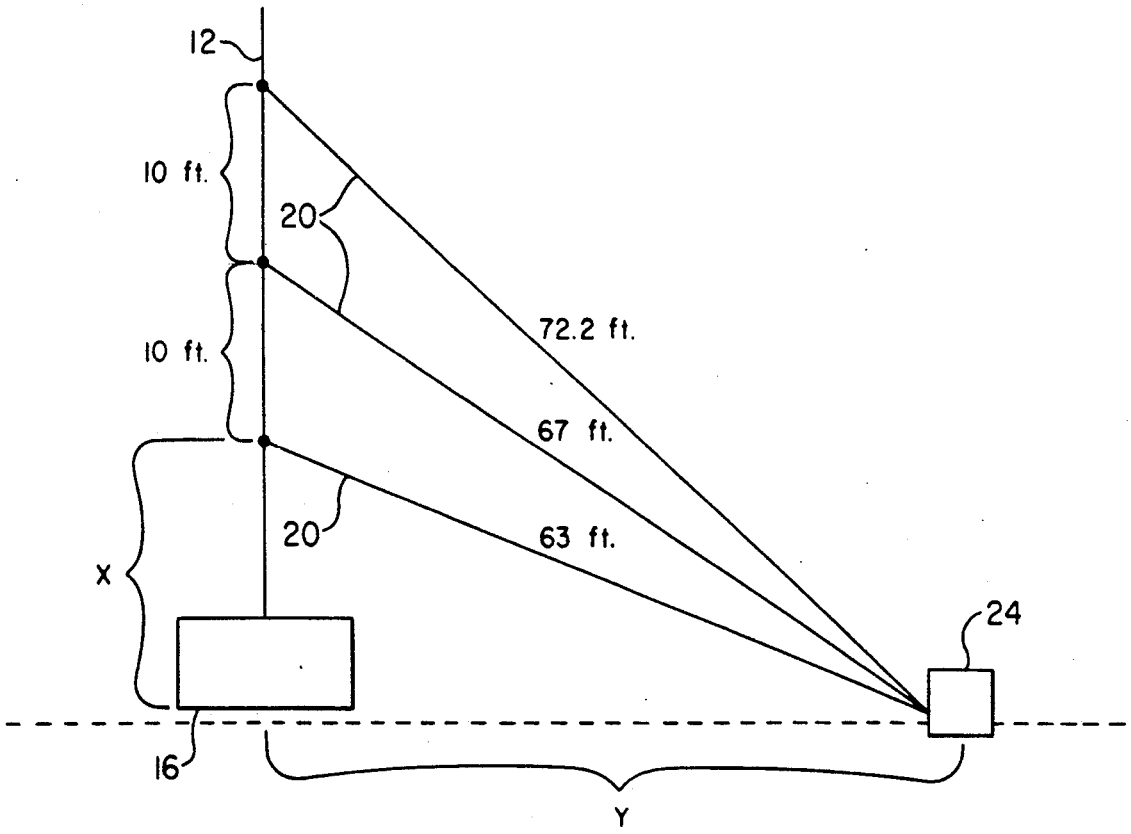
FIG. 6 illustrates a preferred technique used to calculate the relative locations of anchor points.

As described in connection with FIG. 1, three sets of guy cables 20 extend from the mast at angles approximately 120° apart. The elevation of each anchor point assembly 24 may be different, and this is initially unknown to the computer control 28. FIG. 6 illustrates the technique by which the computer control 28 determines the relative locations of the anchor point assemblies 24.

FIG. 6 shows the calculations for only one anchor point assembly 24. An identical calculation, as will now be described, is made for each of the other anchor point assemblies 24.

The anchor point assembly 24 is placed at an unknown distance Y from the base of the mast 12. A guy cable is attached from the anchor point assembly 24 to the mast 12. Initially, this connection point is an unknown height X above a horizontal line passing through the anchor point assembly 24. This typically occurs because the ground between the trailer 16 and anchor point 24 is not level. FIG. 6 shows the anchor point assembly 24 resting on the ground at a height which is slightly lower than that of the trailer 16. This technique will work, however, with any vertical differential between the anchor point assembly 24 and trailer 16.

When the cable 20 is attached to the mast 12, the computer control 28 register the number of length counts generated by the winch 26 to which the guy cable 20 is attached. Preferably an additional piece of cable having a known length can be attached to the end of the cable pulled from the winch 26, so that this additional length need not be stored on the winch drum 86. For purposes of illustrations in FIG. 6, this known length of cable plus any cable deployed from the winch is counted to be 63 feet in length. Initially, this is the only distance known by the computer control 28.

Once one cable has been attached to the mast 12 from each anchor point assembly 24, the computer control 28 causes the mast 12 to be raised for a known distance. FIG. 6 shows this known distance to be 10 feet, but any known distance will suffice. The computer control 28 notes the length of guy cable 20 pulled from the winch 26 as the mast is being raised. In FIG. 6, the example shows that this new length is 67 feet.

The computer control now has all of the information it needs to solve for the unknown values X and Y. Two triangles have been formed, which give two independent equations in two unknowns using the Pythagorean Theorem. These equations are:

$$X^2+Y^2=63^2$$

$$(X+10)^2+Y^2=67^2$$

Substituting the value $Y^2=3969-X^2$ from the first equation into the second equation, gives a value of $X=21$ feet. This value can be substituted back into the first equation to give a value for Y of approximately 59.4 feet. At this time, the horizontal distance between the mast 12 and anchor point assembly 24 is known, as is the current height of the attachment point of the guy cable 20 above a horizontal line through the anchor point assembly 24. This is all the information needed in order to ensure the guy cables 20 are kept at the proper length. The distance Y will always be a positive value, but X can be negative if the anchor point 24 is located at a higher elevation than the trailer 16.

Since the mast is vertical, the computer control 28 simply ensures that the length of the guy cable 20 is proportional to the height of the mast and the horizontal distance between the mast and the anchor point assembly 24 according to the Pythagorean Theorem. For example, if the mast 12 is raised another 10 feet, the square of the length of the guy cable 20 should be $41^2+59.4^2$. This gives a guy cable 20 length of 72.2 feet as shown in FIG. 6.

As described above, the computer control 28 changes the length of the guy cables 20 by varying the tension thereon. This is preferably done repeatedly for small increments of mast height increase, so that the length of the guy cables 20 are gradually changed in accordance with increases or decreases of the mast 12 height.

Figure 7:
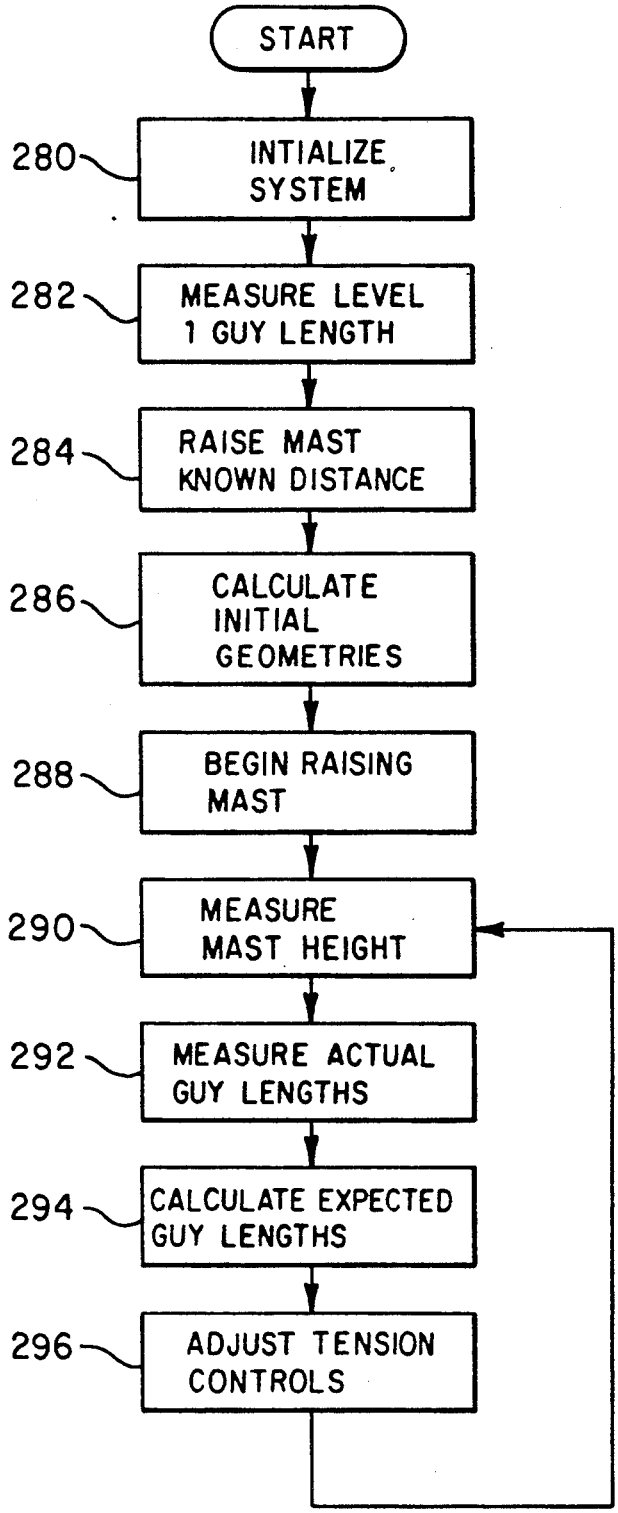
FIG. 7 is a flowchart of a preferred method for automatically controlling the erection of an extensible mast.

FIG. 7 is a flowchart illustrating operation of that portion of the computer control 28 which controls guy cable 20 length as a function of mast 12 height. Controlling of the mast 12 height itself requires simply driving the mast 12 up or down as known in the art.

The first step is to initialize the system 280. This involves powering up and testing the function of all of the electronics, resetting counters, and ensuring that all of the guy cables 20 are fully wound on their winches 26. Next, the level 1 cable length is measured 282. In this step, an extension cable of known length is preferably attached to the guy cable 20 at its end, and also attached to the guy cable coupling 22. As described above, this gives an initial length of guy cable which need not be wound onto the winch 26. The guy cable 20 is adjusted to take up slack, and the final length of this cable is noted by the computer control 28. This process is repeated for one cable from each anchor point assembly 24.

Next, the mast 12 is raised a known distance 284. The initial geometries are calculated 286 as described above with reference to FIG. 6. Once these geometries are calculated, the computer control 28 begins raising the mast 288.

The computer control 28 is then programmed to enter a control loop which constantly adjusts the length of the guy cables as the changing mast 12 and support cable 20 requires. The first step is to note the mast height 290, followed by reading the actual cable lengths 292 for that height. The ideal cable lengths are then calculated 294, and any necessary adjustments are made via the tension controls 296 to lengthen or shorten the cables 20.

The loop consisting of steps 290, 292, 294, and 296 repeats as long as the system is active, i.e. all motors are not inhibited. When a microcomputer of moderate power is used as the computer control 28, such as a Compaq Deskpro 286 or equivalent machine, the endless loop can be repeated on the order of every 200 to 300 milliseconds.

As the mast 12 is raised, additional guy cables 20 are attached at successive levels. Raising of the mast 12 is stopped to allow attachment of a new guy cable coupling 22 and three more guy cables 20. Since the initial geometries are already known, adjusting the length of the additional guy cables 20 is done by the same process used for the original cables. Thus, all cables in the system can be monitored during the control loop by the computer control system 28. Each cable 20 is controlled using the techniques described above for a single cable 20.

A system has been described which provides for automatically controlling the lengths of guy cables when an extensible mast is raised. The control system automatically calculates the geometry of the relative positions of the mast and guy cable anchor points. Once the anchor points are placed and the system initialized, raising of the mast can proceed completely automatically. Such a system can be used to raise a mast several hundred feet at a rate of more than 10 feet/minute.

The system described above has a number of advantages over previous techniques for controlling guy cables while raising and lowering an extensible mast. As described above, the geometry of the relative locations of the mast and anchor points is automatically calculated at the beginning of the mast raising sequence. This allows the mast to be deployed in rugged terrain, since it is not necessary that the mast and anchor points be placed at the same elevation. It is also not required that the various anchor points be located at that same distance from the mast.

Closed loop control is provided for each winch independently. Using four quadrant regenerative controllers as described above, each winch simply maintains a constant tension on its guy cable. As the mast is raised, cable will be paid out from each winch independently at a rate winch maintains a constant tension on the cable. This occurs because raising the mast tends to increase the tension on all cables, generating an error signal between the tension sense signal and the tension set point. This is relieved by paying out cable until the actual tension equals the desired tension. A similar situation occurs when the mast is lowered, so that the cable is automatically taken up by the winch in order to keep the tension thereon constant. The use of compressible mounts for the tension transducer helps ensure that each winch operates independently.

Since cable tension is maintained in the closed loop control for each winch, the central computer control 28 does not have to match tensions on the various guy cables 20. Instead, it simply calculates the geometrical factors of the system in order to keep the mast vertical. If one or more cables become too long or too short, they are shortened or lengthened respectively by changing the appropriate tension set points. This allows the job performed by the computer control to be much simpler; it need only repeatedly calculate the geometry of the system for each cable and adjust the guy tensions accordingly.

Since the computer control is concerned only with system geometry, the effects of wind loading on the mast are automatically accounted for. The computer control is only making relatively simple geometrical calculations for the mast and its guy cables, with the tension control for each cable being handled by the closed loop control for each winch. Additional mast loading due to an antenna which is not centered on the mast is automatically compensated for in the same manner.

If the wind loading on the mast changes, such as occurs when gusts of wind strike the mast, one or more cables will have short lengths pulled off of their winches. The computer control will detect that the affected cables are no longer the correct length, and will compensate by increasing the tension on these cables. This increased tension will dynamically balance the effect of variable wind loading, and maintaining the mast in a vertical orientation. The net result of the overall system design is that if the cable/mast geometry is correct, the cable tensions required to compensate for wind loading and other horizontal loading effects will also be correct.

The software used in the computer controller 28 is straightforward, simply repeating a simple geometrical calculation for each guy cable attached to the mast as described in connection with FIG. 7. It is preferable to match the adjustments made to the errors which occur, so that large errors, and those errors which are accumulating rapidly, are corrected with larger magnitude corrections. Smaller errors and those having slow rates of change require smaller corrections. Using small adjustments in cable tension set points to correct for small cable length errors will prevent over correction and oscillations within the system. Use of large changes in cable tension settings to correct for large errors in cable length will allow the mast to be returned to a vertical orientation as quickly as possible. Critical damping of control signals in feedback loops is well understood by those skilled in the art, and the software controller is preferably designed consistent with standard principles of control engineering.

While the invention has been particularly shown and described with reference to a preferred embodiment, it will be understood by those skilled in the art that various changes in form and detail may be made therein without departing from the spirit and scope of the invention as set forth in the claims.

We claim:

1. A system for erecting an extensible mast, comprising:

an extensible mast erectable at a controllable rate;

first means for determining the height of said extensible mast;

a plurality of guy cables coupled to said extensible mast and to anchor points spaced therefrom;

second means for determining the length of said guy cables; and a controller for maintaining said guy cables at selected lengths, wherein said controller performs the functions of:

obtaining the height of said extensible mast from said first means;

obtaining the actual lengths of said guy cables from said second means;

calculating a selected length for each guy cable which is a function of the height of said extensible mast; and controlling the actual lengths of said cables to match such actual lengths to the calculated selected lengths.

2. The system of claim 1, wherein there are at least 3 anchor points approximately equally spaced around said extensible mast.

3. The system of claim 2, wherein there are exactly 3 anchor points.

4. The system of claim 1, wherein said extensible mast comprises:

three flexible metal tapes making contact along the edges to define a triangular cross-section; and metal cable wrapped around said tapes to hold them securely together.

5. The system of claim 1, wherein said guy cables comprise at least two sets of cables spaced along the height of said extensible mast and connected to a common anchor point.

6. The system of claim 1, wherein, as said extensible mast is raised, said controller controls the rate at which said guy cables are paid out from said anchor points.

7. The system of claim 6, wherein said controller determines a desired tension for each guy cable and causes such tension to be applied thereto, and wherein the desired tension for a cable is increased if the measured length of such cable is longer than the calculated length, and decreased if the measured length is shorter that the calculated length.

8. The system of claim 1, wherein, as said extensible mast is lowered, said controller controls the rate at which said guy cables are taken in to said anchor points.

9. The system of claim 1, wherein said controller controls the actual cable lengths by, for each cable, if it has an incorrect length, changing the tension applied to the cable.

10. The system of claim 9, wherein the cable tension is increased if the cable is too long, and decreased if it is too short.

11. The system of claim 1, wherein said controller calculates the relative positions of said extensible mast and the anchor points.

12. A system for erecting an extensible mast, comprising:

an extensible mast erectable at a controllable rate;

first means for determining the height of said extensible mast;

a plurality of guy cables coupled to said extensible mast and to anchor points spaced therefrom;

second means for determining the length of said guy cables; and a controller for maintaining said guy cables at selected lengths which are a function of the height of said extensible mast, wherein said controller calculates the relative positions of said extensible mast and the anchor points, wherein said controller calculates such relative positions with respect to one anchor point by:

measuring the length of a cable attached to said extensible mast and to the anchor point;

causing said extensible mast to change height by a known distance;

measuring the length of the cable after such change; and calculating, using such measured values, to determine the horizontal distance between said extensible mast and the anchor point and the vertical distance between a horizontal line passing through the anchor point and the location at which the guy cable is attached to said extensible mast.

13. A method for raising an extensible mast, comprising the steps of:

providing cables connected to the mast and to anchor points;

for each anchor point, measuring the length of the cable attached to the mast and the anchor point;

raising the mast a known distance;

measuring the new length of the cable;

calculating the horizontal distance between the mast and the anchor point, and the vertical distance between a horizontal line through the anchor point and the location of the attachment of the cable to the mast to determine the relative positions of the mast and the anchor points;

raising the mast at a known rate; and deploying the guy cables from the anchor points at a rate which corresponds to the known mast raising rate.

14. The method of claim 13, wherein there are three anchor points.

15. The method of claim 13, wherein there are at least two cables connected between the mast and each anchor point.

16. A method for raising an extensible mast, comprising the steps of:

raising the mast at a known rate;

determining the height of a point of attachment to the mast for each guy cable;

determining the actual length of each guy cable;

calculating an expected length for each guy cable which is a function of the height of the attachment point to the mast; and adjusting the lengths of the cables to match the actual lengths to the expected lengths.

17. The method of claim 16, further comprising the step of:

repeating said determining steps and said calculating and adjusting steps while the mast is being raised.

18. The method of claim 16, wherein said adjusting step comprises the steps of:

determining a tension setting for each cable;

for each cable having an acutal length less than its expected length, lowering the tension setting for that cable; and for each cable having an actual length greater than its expected length, increasing the tension setting for that cable.

19. A method for raising an extensible mast, comprising the steps of:

providing cables connected to the mast and to anchor points;

raising the mast; and while the mast is being raised, continuously performing the steps of:

monitoring the mast height;

monitoring the lengths of the cables;

calculating a length for each cable which is a function of the mast height; and if a difference exists between the monitored length and the calculated length of a cable, controlling the length of such cable to correct the difference.

20. The method of claim 19, wherein the length of a cable is controlled by adjusting the tension thereof.

21. The method of claim 20 wherein the cable tension is decreased if its calculated length is greater than its monitored length, and wherein the cable tension is increased if its calculated length is less than its monitored length.

22. The method of claim 19, further comprising the steps of:

prior to raising the mast, measuring the length of the cable connected each anchor point;

raising the mast a known distance; and calculating horizontal and vertical distance relative to the mast for each anchor point.

* * * * *